US011913206B1

(12) United States Patent
Banks

(10) Patent No.: US 11,913,206 B1
(45) Date of Patent: Feb. 27, 2024

(54) SINK MOUNTING APPARATUS

(71) Applicant: Taylor Banks, Hudson, WI (US)

(72) Inventor: Taylor Banks, Hudson, WI (US)

( * ) Notice: Subject to any disclaimer, the term of this patent is extended or adjusted under 35 U.S.C. 154(b) by 0 days.

(21) Appl. No.: 17/750,622

(22) Filed: May 23, 2022

Related U.S. Application Data

(63) Continuation-in-part of application No. PCT/US2020/023639, filed on Mar. 19, 2020, and a continuation-in-part of application No. 16/707,922, filed on Dec. 9, 2019, now Pat. No. 11,339,558.

(60) Provisional application No. 63/251,304, filed on Oct. 1, 2021, provisional application No. 62/790,285, filed on Jan. 9, 2019.

(51) Int. Cl.
*E03C 1/32* (2006.01)
*E03C 1/324* (2006.01)
*E03C 1/33* (2006.01)

(52) U.S. Cl.
CPC ..... *E03C 1/324* (2013.01); *E03C 1/32* (2013.01); *E03C 1/33* (2013.01)

(58) Field of Classification Search
CPC ... E03C 1/324; E03C 1/32; E03C 1/33; E03C 1/335; E03C 1/322; E03C 1/328
USPC ..... 248/200
See application file for complete search history.

(56) References Cited

U.S. PATENT DOCUMENTS 813,588 A 2/1906 Rollins
832,182 A 2/1906 Dimond
2,578,826 A 1/1950 Mrofka
3,034,141 A 5/1962 Albert
3,128,479 A 4/1964 Juergens
3,354,474 A 11/1967 Walter et al.
3,613,128 A 10/1971 Moyer
3,813,707 A 6/1974 Fowell
4,192,118 A * 3/1980 Gilb ..... E04B 1/0007 52/714
4,432,106 A 2/1984 Smith
4,594,017 A 6/1986 Hills
4,613,995 A 9/1986 Ricke
4,665,672 A * 5/1987 Commins ..... F16B 9/058 52/702
4,717,279 A * 1/1988 Commins ..... F16B 9/052 403/187

(Continued)

OTHER PUBLICATIONS

International Search Report and Written Opinion for International Application No. PCT/US2020/023639, dated May 29, 2020, 13 pages.

(Continued)

*Primary Examiner* — Nkeisha Smith
(74) *Attorney, Agent, or Firm* — Westman, Champlin & Koehler, P.A.

(57) ABSTRACT

A bracket includes a mounting flange configured to couple to a mounting surface, and a support member coupled to the mounting flange with at least a portion of the support member being horizontal. The support member comprises a hole that extends from a top surface of the support member to a bottom surface of the support member. The hole is configured to receive an adjustable support. The bracket also includes a first vertical support flange coupled to the mounting flange, and coupled to a first side of the support member, and a second vertical support flange coupled to the mounting flange, and coupled to a second side of the support member.

14 Claims, 19 Drawing Sheets

(56) References Cited

U.S. PATENT DOCUMENTS

| | | | | | |
|---|---|---|---|---|---|
| 4,744,192 | A * | 5/1988 | Commins | F16B 9/052 | 403/232.1 |
| 4,825,621 | A * | 5/1989 | Jensen | E04B 1/2612 | 52/702 |
| 5,092,097 | A * | 3/1992 | Young | E04B 1/2608 | 52/713 |
| 5,249,404 | A * | 10/1993 | Leek | F16B 9/058 | 182/87 |
| 5,467,570 | A * | 11/1995 | Leek | E04B 1/2608 | 52/712 |
| 5,491,932 | A | 2/1996 | Elliott | | |
| 5,538,206 | A | 7/1996 | Sather | | |
| 5,979,130 | A * | 11/1999 | Gregg | F16B 9/058 | 52/702 |
| 6,158,188 | A * | 12/2000 | Shahnazarian | E04B 1/2604 | 52/702 |
| 6,439,522 | B1 | 8/2002 | Yet | | |
| 6,986,174 | B2 | 1/2006 | Brown | | |
| 7,014,383 | B2 * | 3/2006 | Schmid | E04B 1/2604 | 403/231 |
| 7,325,776 | B2 * | 2/2008 | Shibuya | F16L 3/11 | 248/316.1 |
| 7,429,021 | B2 | 9/2008 | Sather et al. | | |
| 7,698,753 | B2 | 4/2010 | Jones et al. | | |
| 8,234,826 | B1 * | 8/2012 | Proffitt, Jr. | E02D 27/00 | 52/712 |
| 8,356,367 | B2 * | 1/2013 | Flynn | E03C 1/33 | 248/500 |
| 8,769,887 | B2 * | 7/2014 | Proffitt, Jr. | E04B 2/58 | 52/696 |
| 9,015,875 | B2 | 4/2015 | Pridemore | | |
| 9,228,338 | B2 * | 1/2016 | Lin | E04B 1/2612 | |
| 9,382,702 | B2 * | 7/2016 | Wisniewski | E03C 1/335 | |
| 9,683,357 | B2 * | 6/2017 | Provencher | E03C 1/335 | |
| 10,087,617 | B2 * | 10/2018 | Daudet | F16M 13/02 | |
| 10,865,558 | B2 * | 12/2020 | Vilasineekul | E04B 1/2612 | |
| 11,142,900 | B2 * | 10/2021 | Ishaq | E04B 1/08 | |
| 11,339,558 | B1 * | 5/2022 | Banks | E03C 1/186 | |
| 2004/0049844 | A1 | 3/2004 | Stone | | |
| 2010/0090072 | A1 | 4/2010 | Jones et al. | | |

OTHER PUBLICATIONS

"Super Fast Sink Bracket" Fabricators For Fabricators LLC, dated Jun. 27, 2014, entire document retrieved online from URL: https://www.youtube.com/watchv=Z2cexu0V8tl&list=PL4RR2ZelpUT8VokgN7bxmH5PwJjrLjV_g&index=4>, 1 page.

HDL® Hardware Distributors Ltd, "Drawer Spacers", manufactured by Bainbridge, originated in U.S., Base SKU: BX3675AL (in production for at least 22 years), downloaded on Sep. 21, 2021, 6 pages.

U.S. Patent Office issued prosecution for U.S. Appl. No. 16/707,922, filed Dec. 9, 2019, including: Notice of Allowance and Fees Due (PTOL-85) dated Jan. 26, 2022, 8 pages; Applicant Initiated Interview Summary dated Nov. 23, 2021, 2 pages; Final Rejection dated Oct. 27, 2021, 11 pages; Applicant Initiated Interview Summary dated Aug. 25, 2021, 2 pages; Non-Final Rejection dated Jul. 15, 2021, 10 pages; Applicant Initiated Interview Summary dated Jun. 1, 2021, 2 pages; Requirement for Restriction-Election dated May 3, 2021.

* cited by examiner

SINK MOUNTING APPARATUS

This application claims the benefit of U.S. provisional application 63/251,304 filed on Oct. 1, 2021, and is a continuation-in-part application of international application PCT/US20/23639 filed on Mar. 19, 2020, and is a continuation-in-part application of U.S. application Ser. No. 16/707,922 filed on Dec. 9, 2019, which claims the benefit of U.S. provisional application 62/790,285 filed on Jan. 9, 2019; the contents of U.S. provisional application 63/251,304, international application PCT/US20/23639, U.S. application Ser. No. 16/707,922, and U.S. provisional application 62/790,285 are hereby incorporated in their entireties.

BACKGROUND

Fixtures such as sinks and other appliances may be installed in countertops, cabinets, vanities, and the like. A variety of construction techniques may be used to mount fixtures within countertop surfaces or cabinets such as in kitchens or bathrooms. Some fixtures utilize an undermount technique to mount the fixture beneath a solid countertop with a cutout portion corresponding with the sink opening. Other designs include apron sinks, or farm sinks, which are installed within a space cut out of the countertop such that front facing side of the sink is exposed. Fixtures are available in various styles and materials and sinks may include steel and porcelain designs. Various countertop materials may also be used which can include granite, marble, quartz stone, quartzite, porcelain, glass, or composite materials. These various fixtures may use materials which are heavy or include designs with uneven surfaces, and the support systems used to mount these fixtures can be space consuming, labor intensive, or unstable.

SUMMARY

This Summary and Abstract are provided herein to introduce a selection of concepts in simplified form that are further described below in the Detailed Description. The Summary and Abstract are not intended to identify key features or essential features of the claimed subject matter, nor are they intended to be used as an aid in determining the scope of the claimed subject matter. The claimed subject matter is not limited to the implementations that solve any or all the disadvantages noted in the background.

In one embodiment, a bracket is provided. The bracket includes a mounting flange configured to couple to a mounting surface, and a support member coupled to the mounting flange with at least a portion of the support member being horizontal. The support member comprises a hole that extends from a top surface of the support member to a bottom surface of the support member. The hole is configured to receive an adjustable support. The bracket also includes a first vertical support flange coupled to the mounting flange, and coupled to a first side of the support member, and a second vertical support flange coupled to the mounting flange, and coupled to a second side of the support member.

In another embodiment, an apparatus is provided. The apparatus includes a mounting bracket comprising a one-piece sheet of metal of uniform thickness having a mounting flange configured to couple to a mounting surface, and a bi-layered support flange coupled to the mounting flange and positioned in a horizontal plane perpendicular to the mounting flange.

In yet another embodiment, a mounting bracket is provided. The mounting bracket includes a mounting flange configured to couple to a mounting surface, and a horizontal support flange portion coupled to the mounting flange via vertical support flange portions. The horizontal support flange portion is positioned in a horizontal plane perpendicular to the mounting flange with a space between the horizontal support flange and the mounting flange.

DETAILED DESCRIPTION

Figure 1:
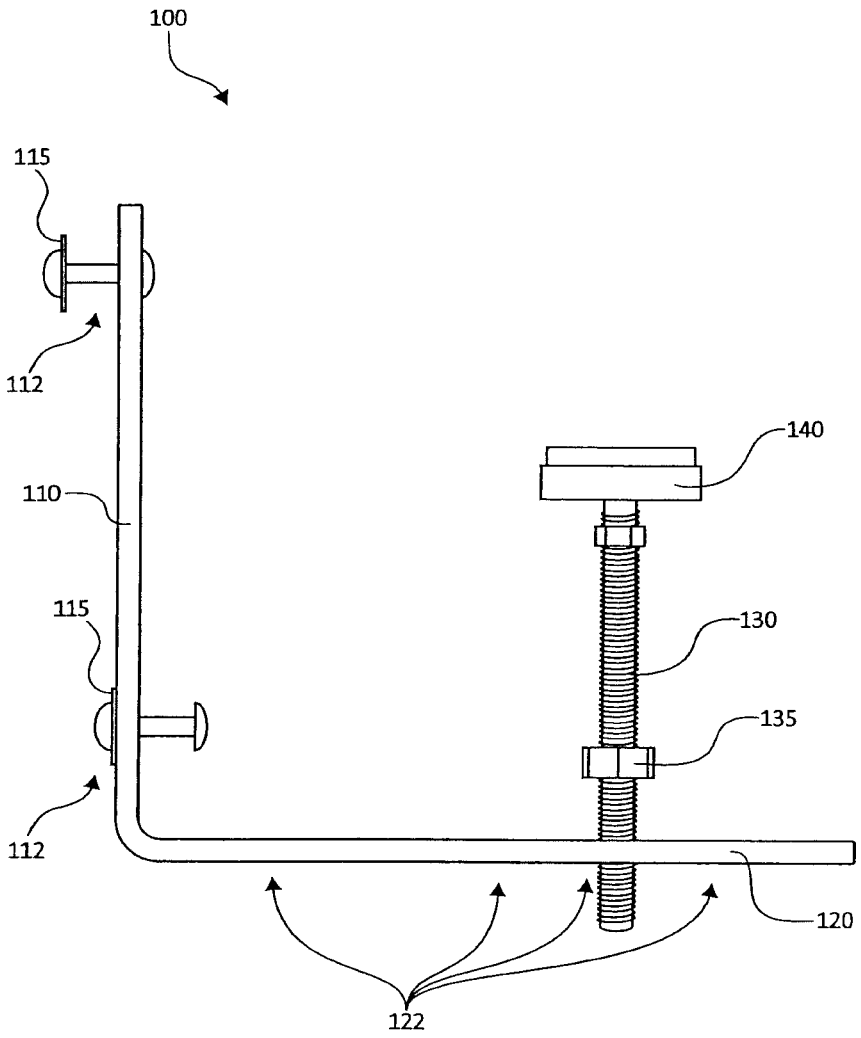
FIG. 1 illustrates a perspective side view of an embodiment of the present disclosure.

Although the present disclosure has been described with reference to certain embodiments, workers skilled in the art will recognize that changes may be made in form and detail without departing from the scope of the disclosure. The present disclosure generally pertains to an apparatus for mounting a sink.

Some methods of sink installation use screws, bolts, or the like, to mechanically attach a mounting apparatus to a sink and countertop. However, fixtures or countertops may be manufactured from fragile materials which can be damaged by the installation method. For example, a sink or counter may crack if a fastener, such as a screw, is over tightened. Further, fixtures may comprise various designs with differently shaped or uneven outer surfaces which may be difficult to mount. A fixture mounting bracket according to embodiments of the present disclosure is configured to adjustably engage and support the outer surface of a fixture without damaging the surface of the fixture or countertop.

It should be noted that like reference numerals are used in different figures for same or similar elements. It should also be understood that the terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps, and do not supply a serial or numerical limitation on the elements or steps of the embodiments thereof. For example, "first," "second," and "third" elements or steps need not necessarily appear in that order, and the embodiments thereof need not necessarily be limited to three elements or steps. It should also be understood that, unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. It should also be understood that the singular forms of "a," "an," and "the" include plural references unless the context clearly dictates otherwise.

It will be understood that, when an element is referred to as being "connected," "coupled," or "attached" to another element, it can be directly connected, coupled or attached to the other element, or it can be indirectly connected, coupled, or attached to the other element where intervening or intermediate elements may be present. In contrast, if an element is referred to as being "directly connected," "directly coupled" or "directly attached" to another element, there are no intervening elements present. Drawings illustrating direct connections, couplings or attachments between elements also include embodiments, in which the elements are indirectly connected, coupled or attached to each other.

FIG. 1 illustrates a mounting bracket 100 for supporting a fixture such as a sink in accordance with the present disclosure. Bracket 100 includes a first flange or mounting flange 110 configured to couple to a mounting surface, such as a wall or interior surface of a fixture cabinet. A second flange or support flange 120 is coupled to the mounting flange 110 and disposed at a substantially right angle to the mounting flange 110. An adjustable support 130 configured to support a fixture extends vertically through support flange 120. The support flange 120 provides a horizontal surface extending from the mounting flange 110 and includes a support hole 122 or plurality of support holes spaced along support flange 120. Holes 122 provide coupling means to engage adjustable support 130 and one or more holes 122 may be included to enable adjustable support 130 to be selectively placed on support flange 120 at various distances from mounting flange 110. Adjustable support 130 is adapted to pass through the hole 122 and comprises a length sufficient to facilitate substantial height adjustment of adjustable support 130 with respect to support flange 120. A contact pad 140 is disposed at a distal end of the adjustable support 130. The contact pad 140 is configured to engage the surface of a fixture, such as the bottom outer-surface of a sink, and support the fixture without damaging the fixture.

Mounting bracket 100 may be comprised of metal, such as steel, however, a variety of materials may be used to provide sufficient strength to support a fixture.

The contact pad 140 may comprise a variety of styles, designs, and materials. Here, contact pad 140 is illustrated as substantially circular, but pads with alternative shapes or thicknesses may be used without departing from the scope of the disclosure. The contact pad may be comprised of plastic or plastic with a metal support backing. However, a variety of materials, such as metal, rubber, or polymeric composite materials, may be used to engage and support the fixture without damaging the fixture.

Adjustable support 130 is configured to adjustably couple to support flange 120 through hole 122 such as by threaded means. In one example, adjustable support 130 may comprise a threaded bolt. Hole 122 may comprise an aperture configured to engage the threads of the adjustable support 130. For example, the aperture of hole 122 may include a lip or threads configured to engage the threads of adjustable support 130 and allow selective movement of support 130. Adjustable support 130 is configured to rotate to telescopically lengthen or shorten relative to support flange 120 and can be selectively extended until contact pad 140 firmly supports the fixture.

Locking means 135 may be provided to secure adjustable support 130 within hole 122 and prevent movement of adjustable support 130 relative to support flange 120. For example, locking means 135 may comprise a threaded nut disposed on adjustable support 130 which may be selectively rotated about support 130 to contact support flange 120 and prevent movement of adjustable support within the threaded aperture of hole 122.

In one embodiment, adjustment means are included to vertically adjust the adjustable support 130. The adjustment means may comprise a shaped recess 132, such as a notch or groove, disposed on the adjustable support 130 at the end opposite the distal end coupled to the contact pad 140. Recess 132 may provide means to mechanically engage adjustable support 130, such as by a screwdriver or other means. For example, a screwdriver may engage recess 132 to rotate adjustable support 130 within the threaded aperture of hole 122. Rotation of adjustable support 130 enables the position of the contact pad 140 to be adjusted relative to the support flange 120. Rotation of adjustable support 130 thus increases or decreases the distance between the contact pad 140 and support flange 120.

The mounting flange 110 comprises a mounting hole 112 or a plurality of mounting holes 112 spaced along the length of mounting flange 110. Mounting means are provided comprising the mounting holes 112 and fasteners 115, such that holes 112 are adapted to receive the fasteners 115 therethrough and allow fasteners 115 to secure the mounting flange 110 to a surface, such as a wall or vertical cabinet surface. Fastener 115 may comprise pins, screws or any mechanical fastener or other suitable means. Alternative mounting means may also be utilized, such as an adhesive.

Figure 2:
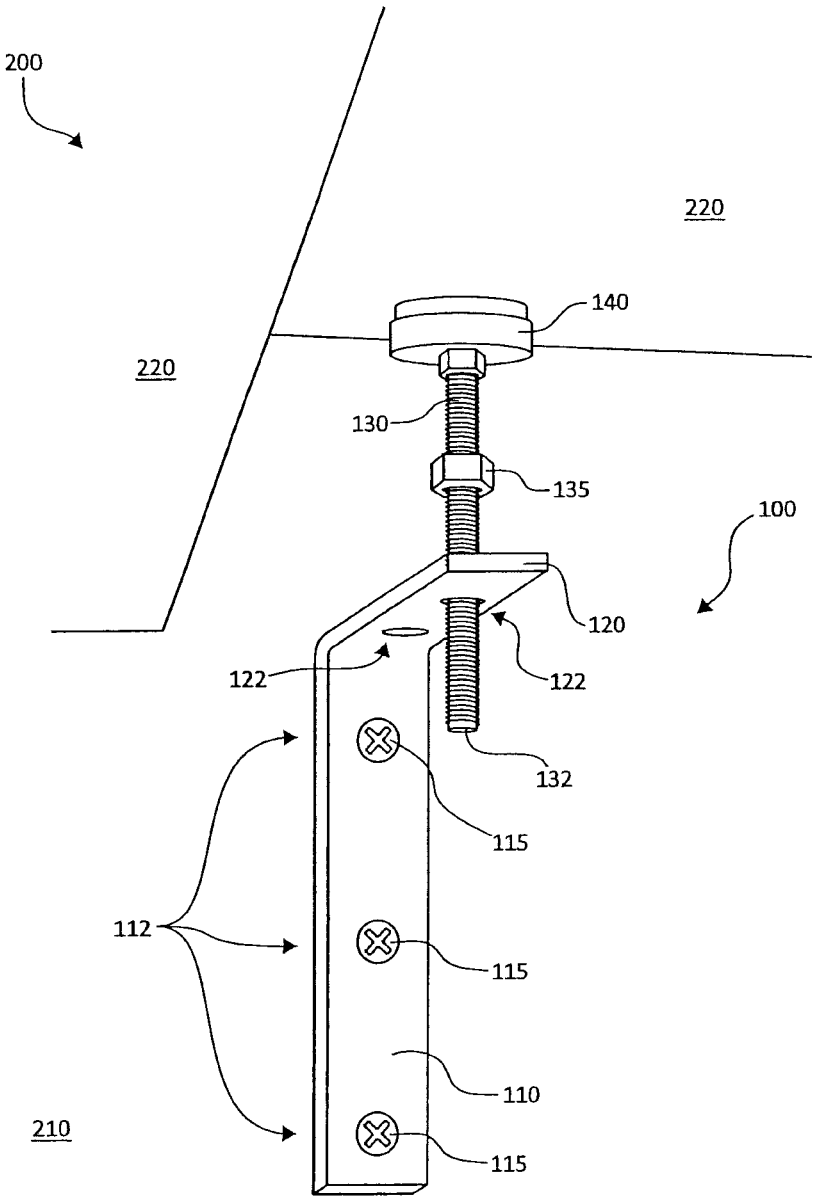
FIG. 2 illustrates a sink mounting assembly according to embodiments of the present disclosure.

FIG. 2 illustrates a sink mounting assembly 200 according to embodiments of the present disclosure. Mounting assembly 200 comprises at least one mounting bracket 100, however, a plurality of mounting brackets 100 may be used in accordance with embodiments of the disclosure. Mounting bracket 100 is within an enclosure, such as a cabinet, with a vertical surface 210, such that mounting bracket 100 is coupled to surface 210 and supports the bottom surface of a fixture 220, such as a sink. Here, mounting flange 110 of mounting bracket 100 is secured to a cabinet surface 210 by fasteners 115. Mounting flange 110 is aligned flush with cabinet surface 210 and positioned to extend vertically along surface 210. Fasteners 115 extend through mounting holes 112 to secure mounting flange 110 to surface 210.

Support flange 120 coupled to mounting flange 110 extends outwards away from surface 210 such that it is substantially horizontal. Adjustable support 130 extends vertically through a support hole 122 and includes locking means 135. The contact pad 140 disposed at the distal end of the adjustable support 130 is shown here in contact with the bottom surface of fixture 220.

Figure 3:
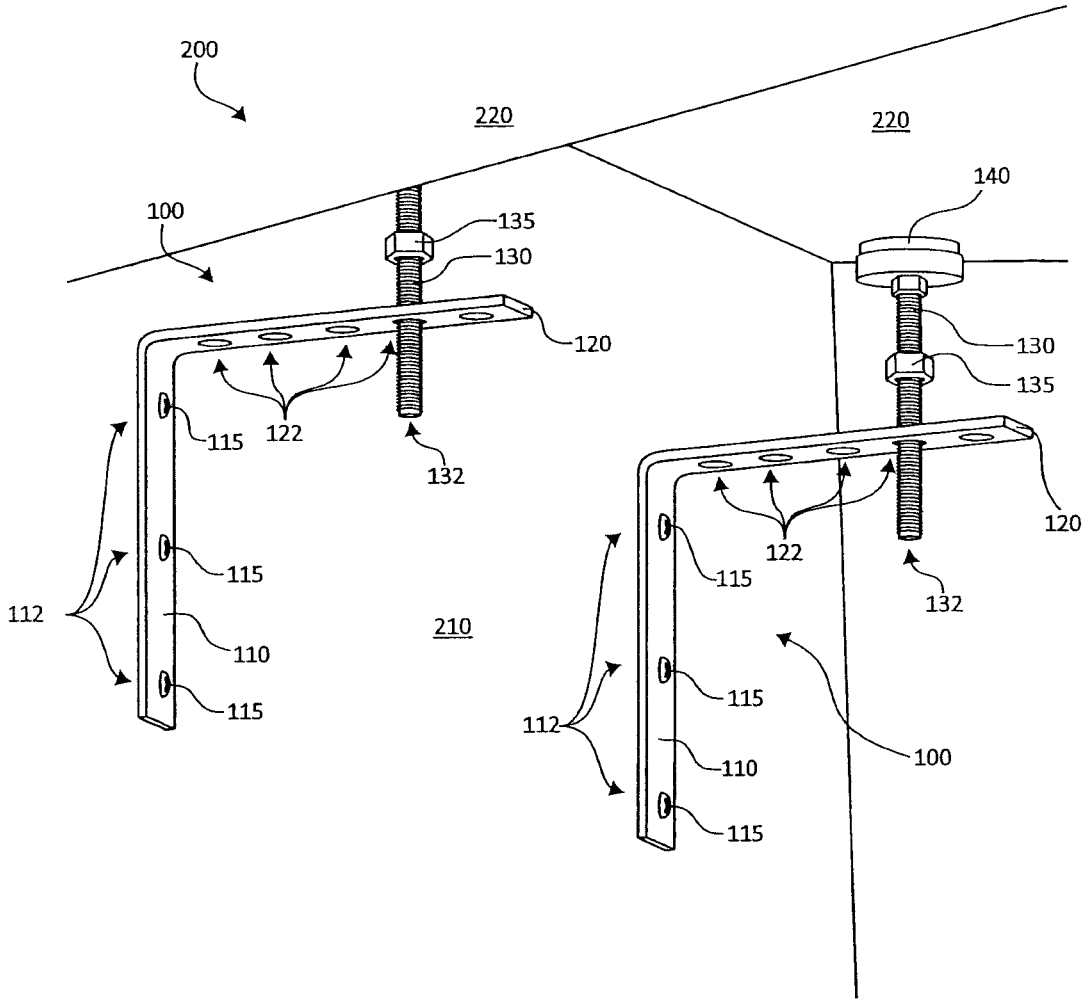
FIG. 3 illustrates the sink mounting assembly of FIG. 2 according to embodiments of the present disclosure.

FIG. 3 illustrates mounting assembly 200 in which multiple mounting brackets 100 are operatively positioned beneath fixture 220. Mounting brackets 100 are mounted on cabinet surface 210, each with an adjustable support 130 and contact pad 140 extending from support flange 120 to support fixture 220. A fixture mounting apparatus such as mounting assembly 200 includes a plurality of mounting brackets 100. Each mounting bracket 100 includes mounting flange 110 configured to couple to a mounting surface 210 and support flange 120 coupled to the mounting flange 110. Support flange 120 is configured to provide a substantially horizontal support surface orthogonal to the mounting bracket 110. A selectively adjustable support 130 extends vertically through an aperture of the support flange 120. A contact pad 140 is disposed on a distal end of the adjustable support 130 to contact and support fixture 220. The plurality of mounting brackets 100 are spaced around an interior surface 210 of a fixture cabinet and mounted to the cabinet surface. The fixture 220 is disposed within the fixture cabinet and supported by each of the adjustable supports 130 when installed.

For example, each bracket 100 may be positioned beneath the fixture 220 and each mounting flange 110 mounted to mounting surface 210 of a cabinet. Adjustable support 130 may be placed through the desired aperture of hole 122 and selectively extended. Once adjustable support 130 has been extended such that contact pad 140 is supporting the fixture 220, locking means 135 may be tightened to secure the position of the adjustable support on the support flange 120. The fixture will be mounted once each adjustable support 130 is securely engaged with the outer surface of the fixture 220.

Figure 4:
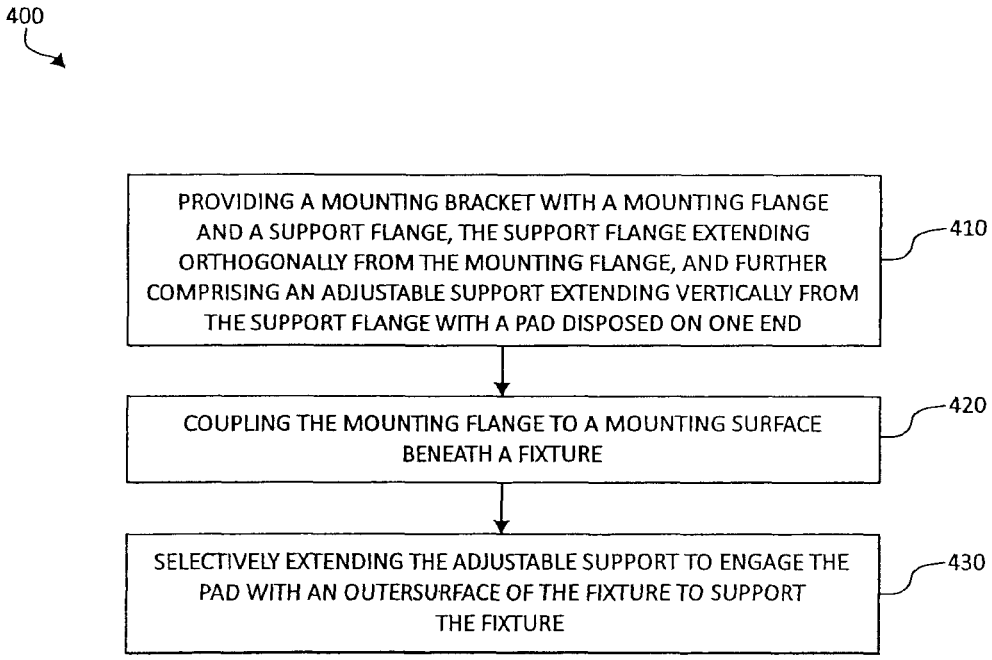
FIG. 4 is a flowchart of a method according to embodiments of the present disclosure.

Sinks and other fixtures may be mounted in a cabinet or countertop according to various methods. FIG. 4 is a flowchart of a method 400 of mounting a fixture. The method 400 includes providing 410 a mounting bracket with a mounting flange and support flange. The support flange extends orthogonally from the mounting flange and is further coupled to an adjustable support extending vertically from the support flange with a pad disposed on one end. Next, the method 400 includes coupling 420 the mounting flange to a mounting surface beneath a fixture. The method 400 further includes selectively extending 430 the adjustable support to engage the pad with an outer surface of the fixture to support the fixture.

Mounting bracket 100 is described above as comprising mounting flange 110 and a support flange 120 formed in a substantially "L" shaped bracket. However, a sink mounting assembly may use a mounting bracket comprising a variety of shapes and sizes without departing from the scope of the disclosure. For example, the mounting bracket may comprise a triangle bracket, or use similar features, such that a third flange (see, e.g., flange 605 of FIG. 6) couples diagonally between the mounting flange and the support flange. The third flange provides greater mechanical strength to the support flange when supporting a fixture. Other embodiments may include variations in the support flange, such as additional bends, additional flanges or supporting features coupling the mounting flange or the support flange, or alternative configurations of the mounting flange.

Figure 5:
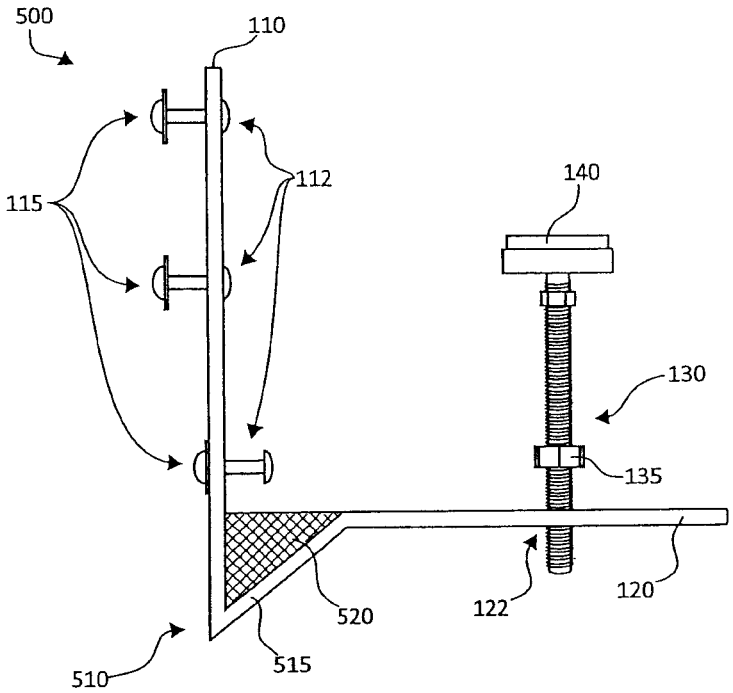
FIG. 5 illustrates a mounting bracket according to another embodiment of the present disclosure.

FIG. 5 illustrates a mounting bracket 500 with a bridge flange 515 according to another embodiment of the present disclosure. Similar to FIGS. 1-3, mounting bracket 500 includes a mounting flange 110 and support flange 120. FIG. 5 further includes a brace 510 feature which couples the flanges. In one embodiment, brace 510 comprises bridge flange 515 coupling the mounting flange 110 to the support flange 120, such that bridge flange 515 extends from the mounting flange 110 in a plane that is other than orthogonal. For example, the bridge flange 515 may extend upwards at an angle to form a space between the surface of mounting flange 110 and the bridge flange 515. The support flange 120 extends from the bridge flange 510 in a plane generally horizontal to the mounting flange 110 and provides an aperture configured to engage adjustable support 130.

In one embodiment, brace 510 may further comprise additional bracing material 520 in the space between the surface of mounting flange 110 and the bridge flange 515. Bracing material 520 may provide additional mechanical support to the support flange when supporting a fixture. For example, bracing material 520 may include properties that resist tensile forces between the support flange and mounting flange caused when downward pressure is placed on the support flange (e.g., when the mounting bracket is supporting a fixture on the support flange). Bracing material 520 may comprise any suitable material, such as plastic, metal, or a composite material, which may provide additional strength to the mounting bracket.

Although bridge flange 515 is illustrated as extending at an upward angle from mounting flange 110, various configurations may be used without departing from the scope of the disclosure. Here, bridge flange 515 extends upwards at a substantially 45 degree angle from flange 110, however, different angles may be used. The brace 510 may also include additional bends or bracing materials to be adapted to different mounting conditions. For example, bridge flange 515 may be adapted to enable the mounting bracket to be mounted within confined spaces or to accommodate cabinets or fixtures of different sizes or designs.

It should be noted a bracket (e.g., bracket 100, 500) may be placed in a flipped or upside down configuration according to embodiments of the present disclosure. For example, bracket 500 is illustrated in an alternate configuration compared to FIGS. 2-3. In FIGS. 2-3, mounting bracket 100 is configured with support flange 120 extending from the top of mounting flange 110, such that adjustable support 130 extends above the flanges. In contrast, FIG. 5 shows a configuration similar to FIG. 1 wherein support flange 120 extends horizontally from the bottom of mounting flange 110 such that mounting flange 110 extends vertically upwards above support flange 120 alongside mounting flange 110.

Figure 6:
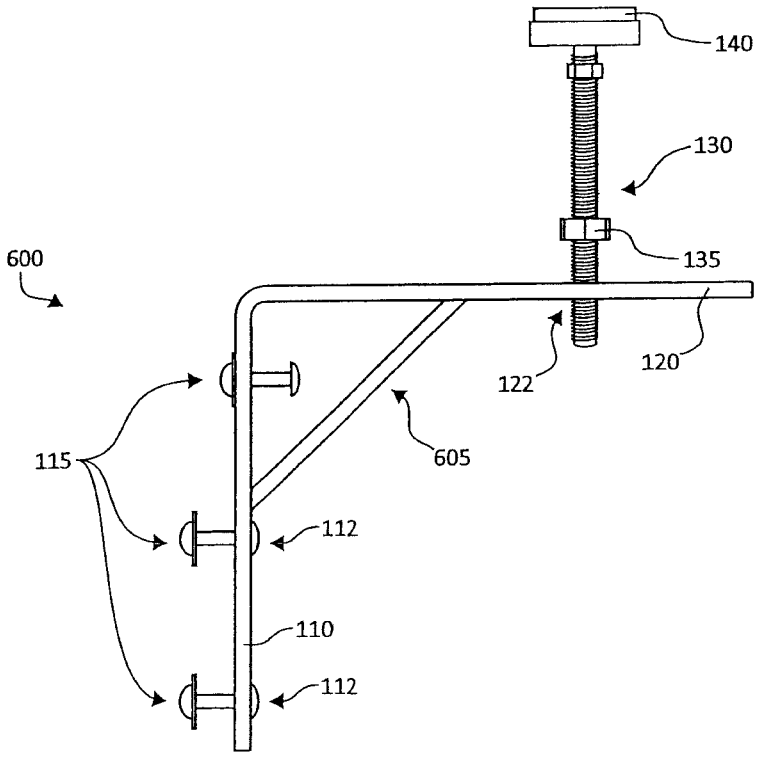
FIG. 6 illustrates a sink mounting assembly according to embodiments of the present disclosure.

FIG. 6 illustrates a side view of mounting bracket 600 which includes a third flange or brace flange 605. Similar to mounting bracket 100 and 500, bracket 600 includes mounting flange 110 and support flange 120 coupled at a substantially right angle. Flange 605 couples diagonally between the mounting flange 110 and the support flange 120 to form a brace therebetween. The third flange 605 provides greater mechanical strength to the support flange 120 when supporting a fixture. As can be seen, mounting bracket 600 is configured similar to FIGS. 2-3 such that mounting flange 110 extends beneath support flange 120. In an alternative embodiment, mounting flange 110 may extend above support flange 120 and a third flange may couple the flanges.

In the above mounting brackets (e.g., mounting bracket 100, 500, 600) the support flange 120 extends from an upper or lower end of the mounting flange 110 to form a substantially "L" shape, however, alternative embodiments may be used. For example, support flange 120 may extend from mounting flange 110 from a point between the upper and lower end in a substantially "T" shape. In other embodiments, support flange 120 may extend from mounting flange 110 at a different position or at an angle other than horizontal. Alternative configurations are possible and flange configurations may be adapted to accommodate various mounting conditions according to embodiments of the present disclosure.

Figure 7:
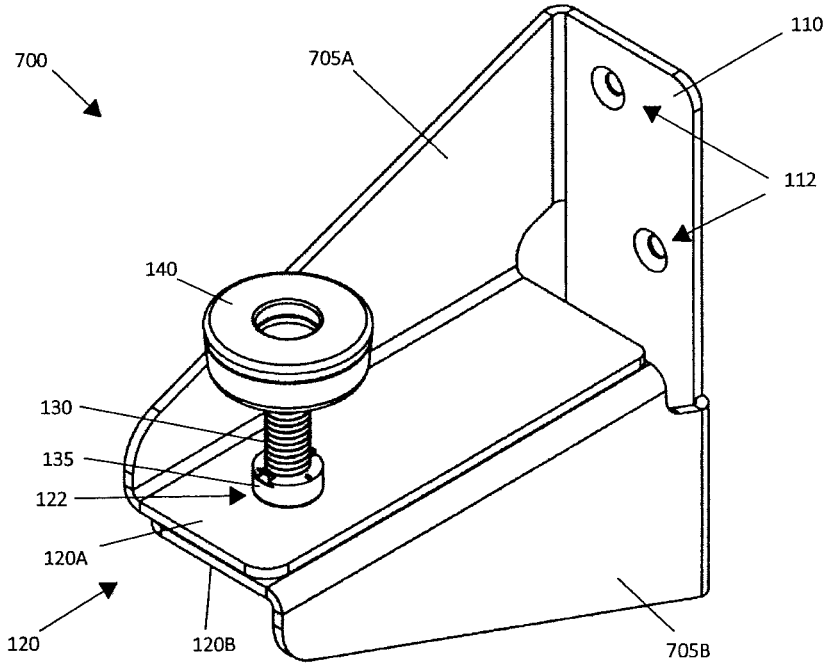
FIGS. 7 and 8 illustrate perspective views of a sink mounting assembly according to another embodiment of the present disclosure.
Figure 8:
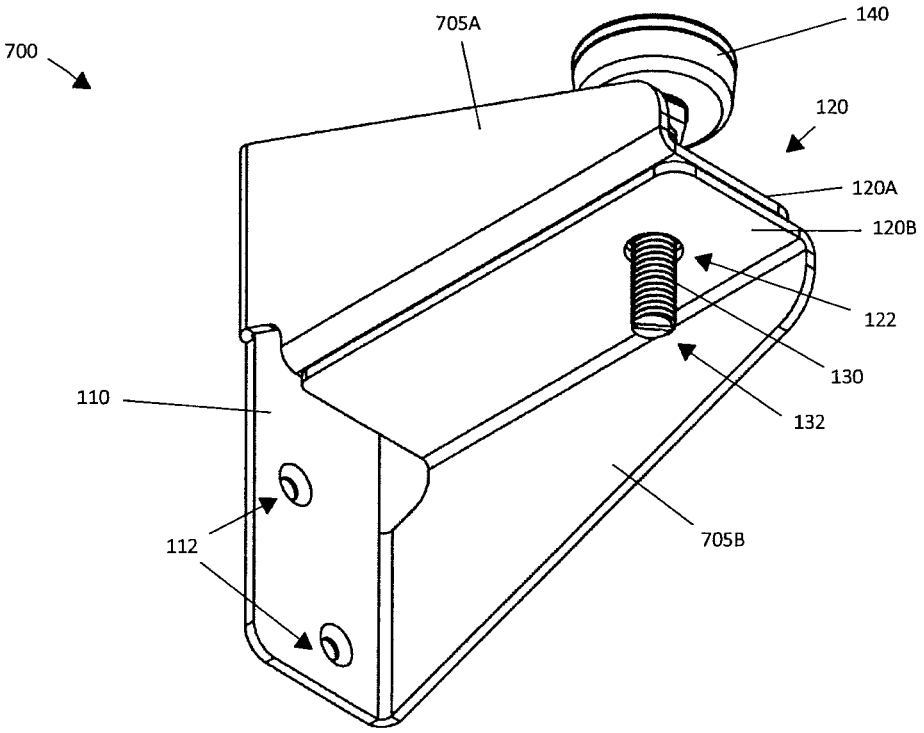
Figure 9:
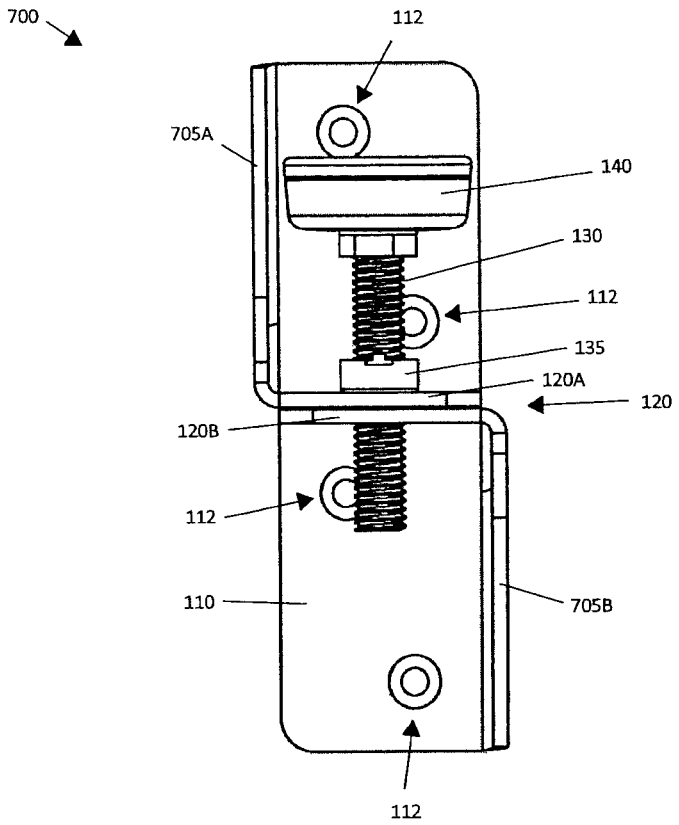
FIG. 9 illustrates a front view of the sink mounting assembly of FIGS. 7 and 8.

FIGS. 7-9 illustrate views of mounting bracket 700 with planar support flanges 705A,B. FIG. 7 illustrates a top side view of mounting bracket 700. FIG. 8 illustrates a bottom side view of mounting bracket 700. FIG. 9 illustrates a front view of mounting bracket 700. Similar to FIGS. 1-3, mounting bracket 700 includes a mounting flange 110, a support flange 120 that is substantially perpendicular to mounting flange 110, and an adjustable support 130 configured to adjustably couple to support flange 120. Here, the support flange 120 is formed by upper support flange 120A and lower support flange 120B such that support flange 120 is substantially perpendicular to mounting flange 110 at a point between the upper and lower end of mounting flange 110.

Planar support flanges 705A,B extend from a vertical side of mounting flange 110 such that upper planar support flange 705A extends from one side of the upper end of mounting flange 110, and lower planar support flange 705B extends from one side of the lower end of mounting flange 110.

In one example, each planar support 705A,B extends outwards substantially orthogonal from mounting flange 110 and includes a bend to form a part of support flange 120. As shown, upper planar support 705A bends to form upper support flange 120A and lower planar support 705B bends to form lower support flange 120B. Each support flange 120A,B includes an aperture which aligns to form support hole 122 and provides coupling means to engage adjustable support 130. Locking means 135 may be provided to secure adjustable support 130 within hole 122 and prevent movement of adjustable support 130 relative to support flange 120. Although one hole 122 is shown, one or more holes 122 may be included in support flange 120 without departing from the scope of the disclosure.

The embodiment shown may be cut from a sheet as a single piece and bent to form the structure of mounting bracket 700. For example, each planar support 705A,B and support flange 120A,B respectively may be formed as a unitary piece with mounting flange 110 and folded to form the structure of mounting flange 110 and support flange 120. However, a sink mounting assembly may be formed using separate pieces, and a variety of methods may be used without departing from the scope of the disclosure.

Figure 10:
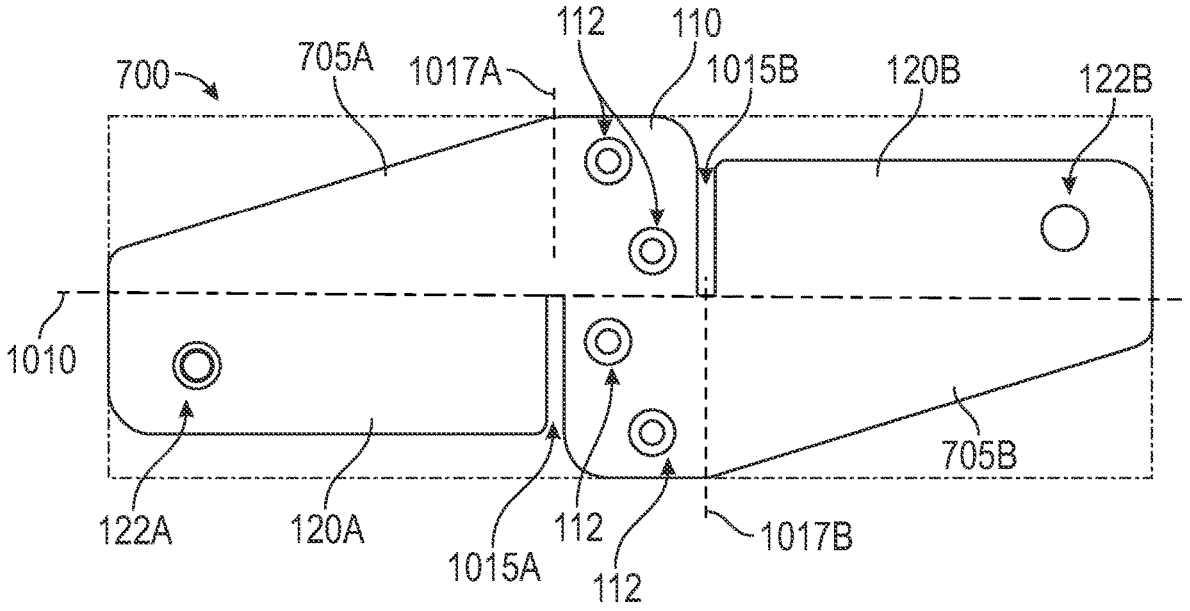
FIG. 10 illustrates a flat sheet lying on a vertical plane which may be folded to form the structure of the sink mounting assembly of FIGS. 7-9.

FIG. 10 illustrates mounting bracket 700 as a flat sheet lying on a vertical plane which may be folded to form the structure of mounting bracket 700. A horizontal axis shown by line 1010, passes through the middle of the vertical plane and forms a horizontal plane. Slits 1015A and 1015B may be formed parallel to one another on opposing sides of the horizontal axis 1010, such that slit 1015A lies below axis 1010 and slit 1015B lies above axis 1010. Slits 1015A,B are formed on vertical axis on either side of mounting flange 110, shown here as dotted lines 1017A,B respectively. In one example, the back end of slits 1015A,B are inside the horizontal plane 1010. In another example, the slits 1015A,B may be different lengths, such that the back ends of slits 1015A,B extend past horizontal axis 1010, or end before passing horizontal axis 1010. Mounting holes 112 may be spaced along the length of mounting flange 110 such that the mounting holes 112 above the horizontal axis 1010 may be placed asymmetrical to the mounting holes 112 below horizontal axis 1010.

Each support flange 120A,B includes hole 122A,B respectively. As can be seen, holes 122A,B are not aligned when bracket 700 is in a flat, unfolded configuration, but holes 122A,B become aligned when bracket 700 is in a folded configuration, as shown in FIGS. 7-9. To align holes 122A,B, each support flange 120A,B is folded about the horizontal axis 1010 to align with the horizontal plane of axis 1010. Each planar support 705A,B may be folded about the vertical axis on lines 1017A,B and bent towards mounting flange 110. In one embodiment, support flange 120A is aligned above support flange 120B. Once holes 122A,B are aligned, they provide a passage through the top surface of flange 120A to the bottom surface of flange 120B which is configured to provide coupling means to engage the adjustable support 130, such as by forming a threaded aperture.

In one embodiment, support hole 122A is smaller than support hole 122B. In a second embodiment, hole 122A is of equal size to hole 122B. In another embodiment, hole 122A may include a raised element surrounding hole 122A, where in one example, the raised element has a smaller diameter than the diameter of hole 122A, and in another example the raised element has a diameter equal to hole 122A.

In a further embodiment, holes 112 may include a countersink feature formed of a tapered hole with a wider outer portion on the surface of the mounting flange 110 such that a fastener 115 may sit flush with or below the surface of mounting flange 110.

The embodiment of FIG. 10 using a folding design produces a support flange 120 with a double layer formed by the upper and lower flanges 120A,B. This feature allows bracket 700 to support a greater weight than other sink mounts. The planar support flanges 705A,B further provide greater load-bearing support to the support flange 120 when supporting a fixture. As can be seen, upper support flange 705A supports upper flange 120A from an end near mounting flange 110 to the end near support hole 122A, allowing bracket 700 to greater resist downward forces placed on adjustable support 130 when supporting a fixture. Further, lower support flange 705B supports lower flange 120B from an end near mounting flange 110 to the end near support hole 122B, and provides upward support to adjustable support 130 against the downward force of a fixture. Thus, the structure of planar supports 705A,B and support flanges 120A,B provide upper and lower load-bearing structures to transmit fixture loads from the adjustable support 130, at the end of the horizontal support flange 120A,B, to the vertical length of mounting flange 110.

FIGS. 11-21 show different views of a sink mounting bracket 1100 in accordance with another embodiment. In some embodiments, sink mounting bracket 1100 may be made of plastic, and may be smaller and/or lighter than some of the earlier-described brackets, which may be formed of metal. In general, mounting bracket 1100 may be made of any suitable material.

Figure 11:
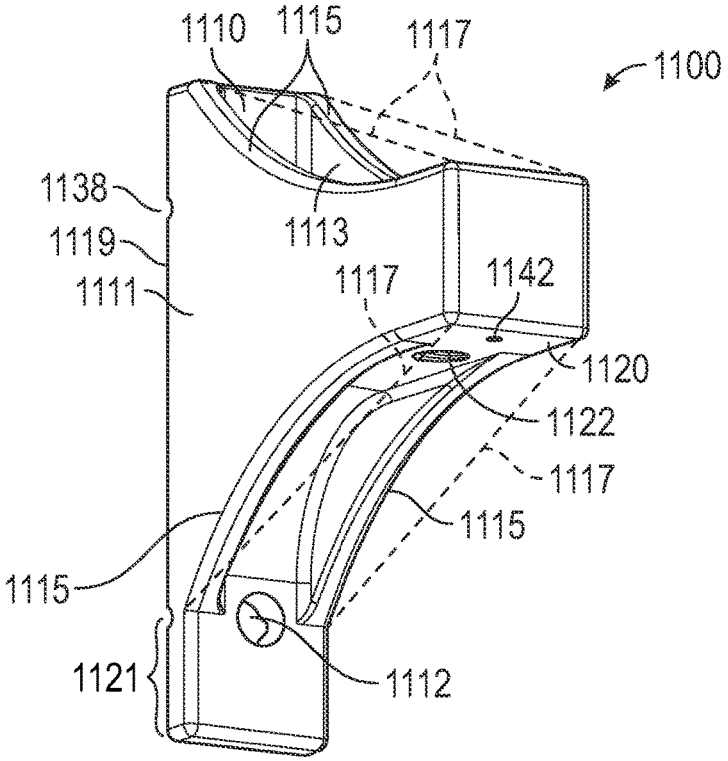
FIGS. 11 and 12 illustrate perspective views of a sink mounting bracket according to another embodiment of the present disclosure.
Figure 12:
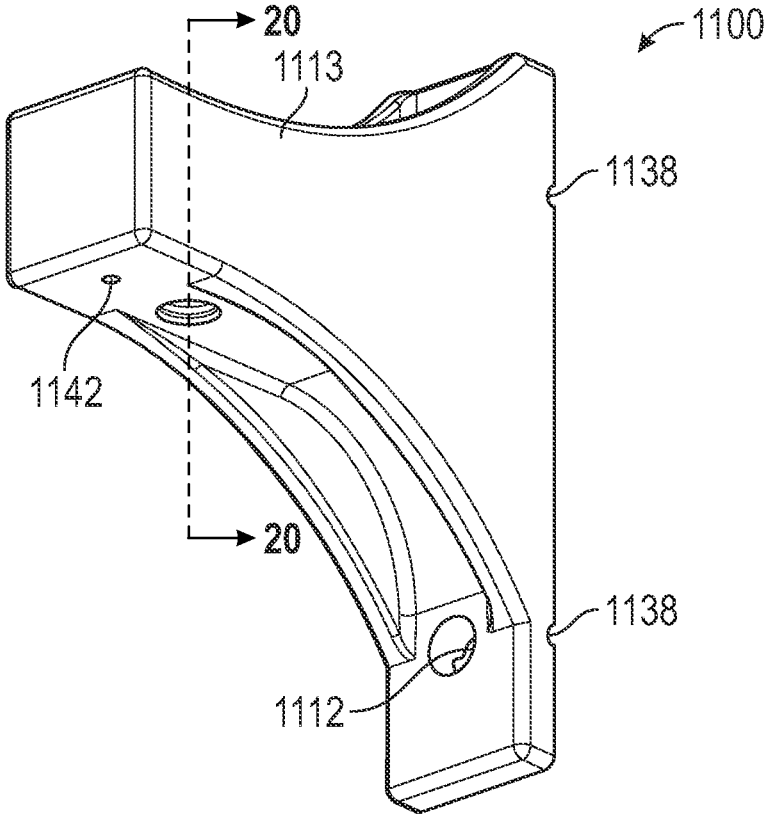
Figure 13:
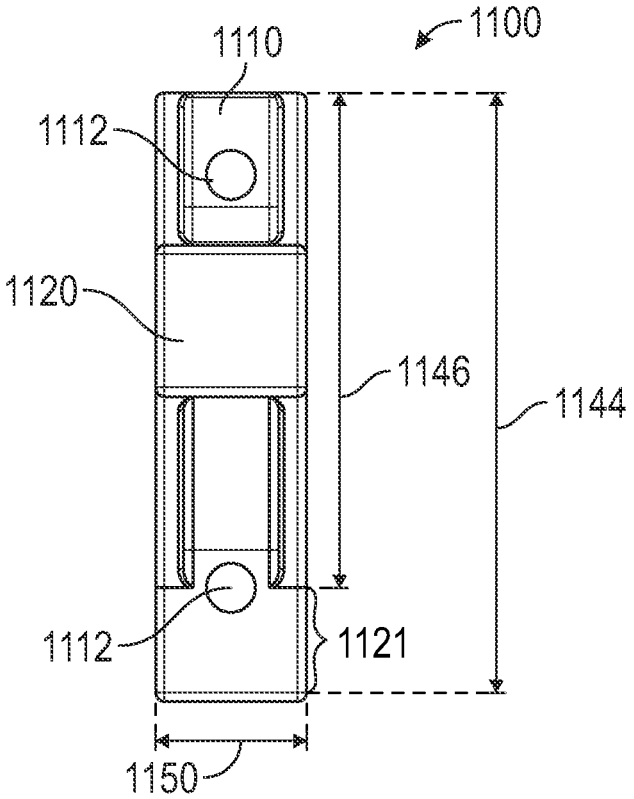
FIG. 13 illustrates a front view of the sink mounting bracket of FIGS. 11 and 12.

As can be seen in FIGS. 11, 12 and 13, sink mounting bracket 1100 includes mounting flange 1110 configured to couple to a mounting surface, such as a wall or interior surface of a fixture cabinet, and a horizontal support flange 1120 that is coupled to the mounting flange 1110 and disposed at a substantially right angle to the mounting flange 1110. A first vertical support flange 1111 is coupled to the mounting flange 1110, and coupled to a first side of the horizontal support flange 1120. Similarly, a second vertical support flange 1113 is coupled to the mounting flange 1110, and coupled to a second side of the horizontal support flange 1120. Vertical support flanges 1111 and 1113 provide support/strength to the horizontal support flange 1120. In some embodiments, vertical support flanges 1111 and 1113 have curved edges 1115. However, in other embodiments, vertical support flanges may have straight edges 1117. In general, vertical support flanges 1111 and 1113 may have any suitable shape. In the embodiment of FIGS. 11-22, back/rear ends 1119 of the vertical support flanges 1111 and 1113 have a length/height that is less than a length/height of the mounting flange 1110. Accordingly, a bottom portion 1121 of the mounting flange 1110 extends below the rear ends 1119 of the vertical support flanges 1111 and 1113.

Figure 21:
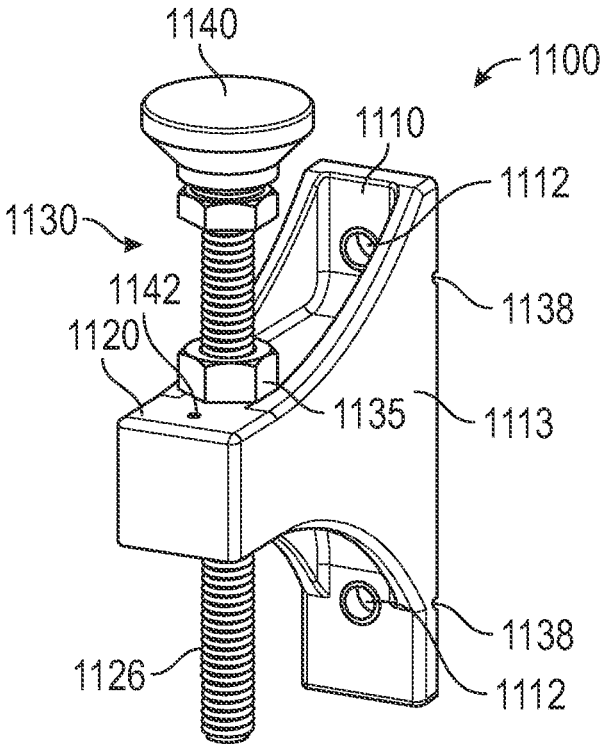
FIG. 21 is a perspective view of a sink mounting assembly including the sink mounting bracket of FIGS. 11 and 12.

The horizontal support flange 1120 provides a horizontal surface extending from the mounting flange 1110 and includes a support hole 1122 or plurality of support holes spaced along support flange 1120. Hole 1122 is included to engage an adjustable support 1130 (shown in FIG. 21), which is configured to support a fixture and extends vertically through support flange 1120. In some embodiments, a plurality of holes 1122 may be included to enable adjustable support 1130 to be selectively placed on support flange 1120 at various distances from mounting flange 1110. Referring now to FIG. 21, adjustable support 1130 is adapted to pass through the hole 1122 and comprises a length sufficient to facilitate substantial height adjustment of adjustable support 1130 with respect to support flange 1120. A contact pad 1140 is disposed at a distal end of the adjustable support 1130. The contact pad 1140 is configured to engage the surface of a fixture, such as the bottom outer-surface of a sink, and support the fixture without damaging the fixture.

The contact pad 1140 may comprise a variety of styles, designs, and materials. Here, contact pad 1140 is illustrated as substantially circular, but pads with alternative shapes or thicknesses may be used without departing from the scope of the disclosure. The contact pad may be comprised of plastic or plastic with a metal support backing. However, a variety of materials, such as metal, rubber, or polymeric composite materials, may be used to engage and support the fixture without damaging the fixture.

Adjustable support 1130 is configured to adjustably couple to support flange 1120 through hole 1122 such as by threads. In one example, adjustable support 1130 may comprise a threaded bolt. Hole 1122 may comprise an aperture configured to engage threads 1126 of the adjustable support 1130. For example, the aperture of hole 1122 may include a lip or threads (denoted by reference numeral 1128 in the cross sectional view of FIG. 20) configured to engage the threads 1126 of adjustable support 1130 and allow selective movement of support 1130. Adjustable support 1130 is configured to rotate to telescopically lengthen or shorten relative to support flange 1120 and can be selectively extended until contact pad 1140 firmly supports the fixture.

A locking mechanism 1135 may be provided to secure adjustable support 1130 within hole 1122 and prevent movement of adjustable support 1130 relative to horizontal support flange 1120. For example, locking mechanism 1135 may comprise a threaded nut disposed on adjustable support 1130 which may be selectively rotated about support 1130 to contact horizontal support flange 1120 and prevent movement of adjustable support within the threaded aperture of hole 1122.

In one embodiment, an adjustment mechanism is included to vertically adjust the adjustable support 1130. The adjustment mechanism may comprise a shaped recess, such as a notch or groove (e.g., 132 0f FIG. 8), disposed on the adjustable support 1130 at the end opposite the distal end coupled to the contact pad 1140. The recess may provide a mechanism to mechanically engage adjustable support 1130, such as by a screwdriver or other means. For example, a screwdriver may engage the recess to rotate adjustable support 1130 within the threaded aperture of hole 1122. Rotation of adjustable support 1130 enables the position of the contact pad 1140 to be adjusted relative to the horizontal support flange 1120. Rotation of adjustable support 1130 thus increases or decreases the distance between the contact pad 1140 and support flange 1120.

The mounting flange 1110 comprises a mounting hole 1112 or a plurality of mounting holes 1112 spaced along the length of mounting flange 1110. A mounting mechanism is provided comprising the mounting holes 1112 and fasteners (e.g., 115 of FIG. 3), such that holes 1112 are adapted to receive the fasteners therethrough and allow fasteners to secure the mounting flange 1110 to a surface, such as a wall or vertical cabinet surface. The fasteners may comprise pins, screws or any mechanical fastener or other suitable means. Alternative mounting mechanisms may also be utilized, such as an adhesive.

In embodiments in which the sink mounting bracket 1100 is formed of plastic, mounting holes 1112 may include metal sleeves/inserts 1132 shown in FIG. 21. The metal sleeves 1132 may help protect the plastic when fasteners are inserted into holes 1112 and tightened (especially when the fasteners may be overtightened), and may also help with load bearing.

Figure 14:
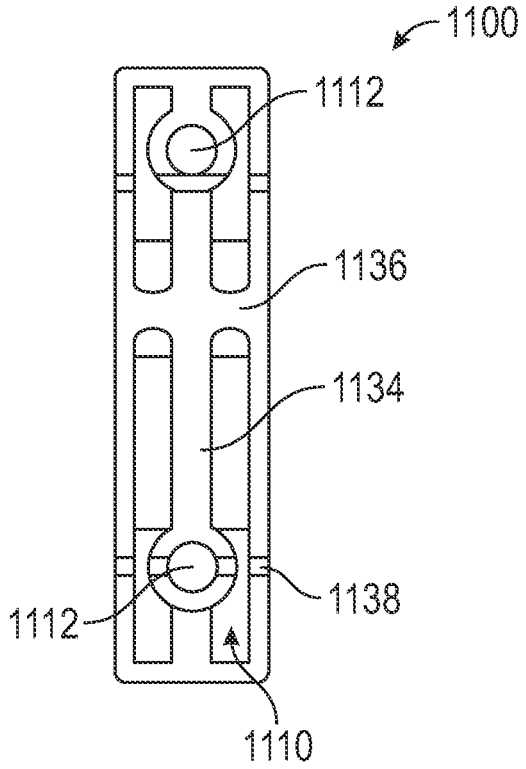
FIG. 14 illustrates a rear view of the sink mounting bracket of FIGS. 11 and 12.
Figure 15:
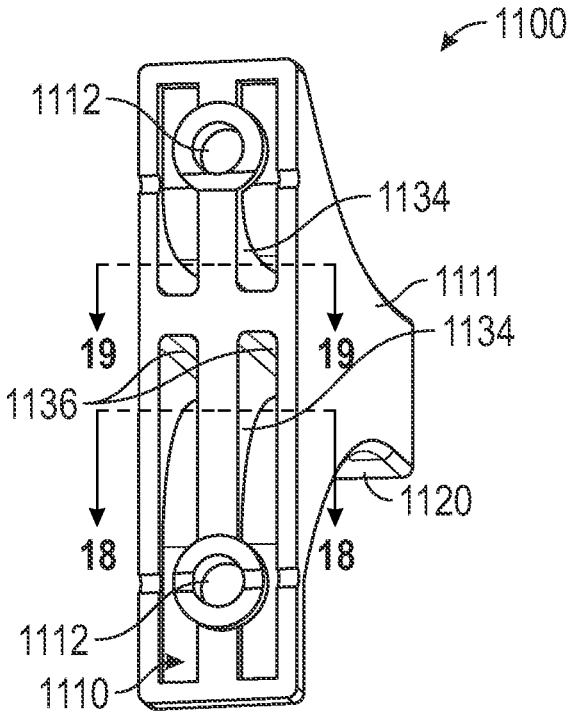
FIG. 15 illustrates a rear perspective view of the sink mounting bracket of FIGS. 11 and 12.
Figure 16:
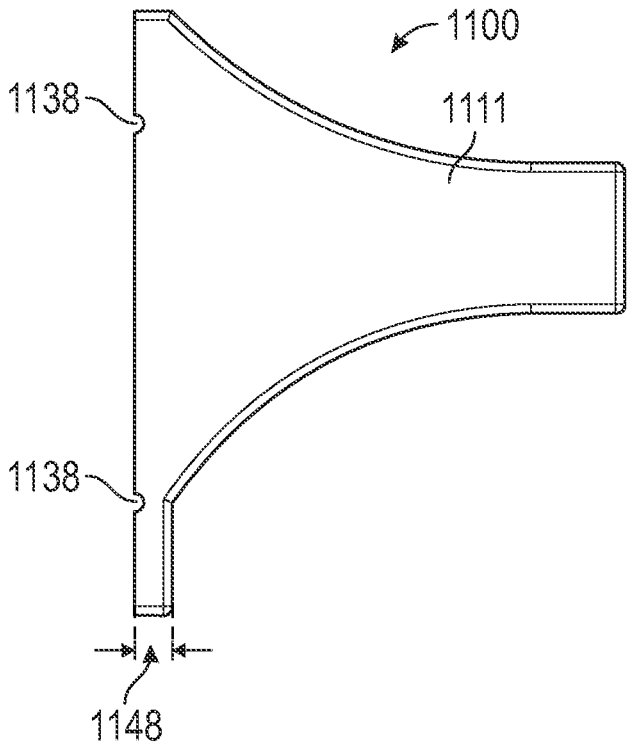
FIG. 16 illustrates a first side view of the sink mounting bracket of FIGS. 11 and 12.
Figure 17:
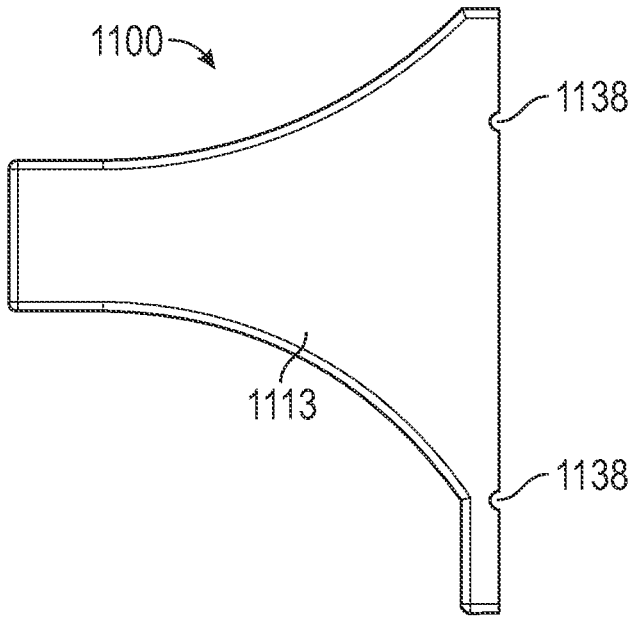
FIG. 17 illustrates a second side view of the sink mounting bracket of FIGS. 11 and 12.
Figure 18:
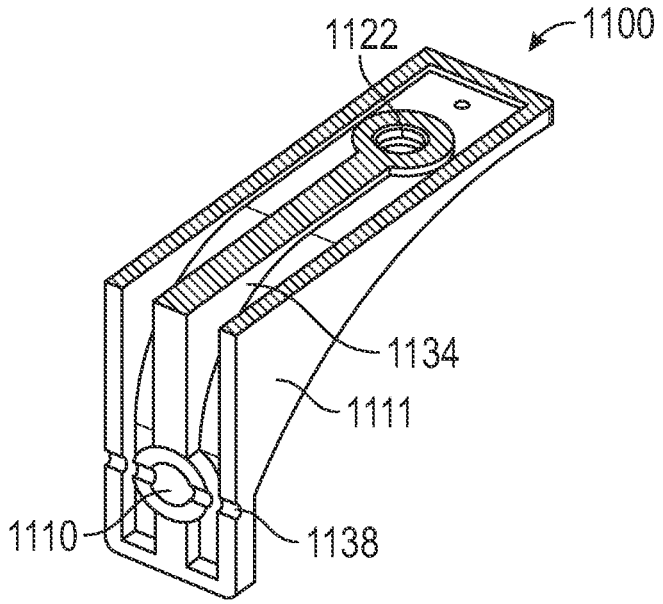
FIG. 18 is a cross sectional view of the sink mounting bracket of FIG. 15, taken along line 18-18 of FIG. 15.
Figure 19:
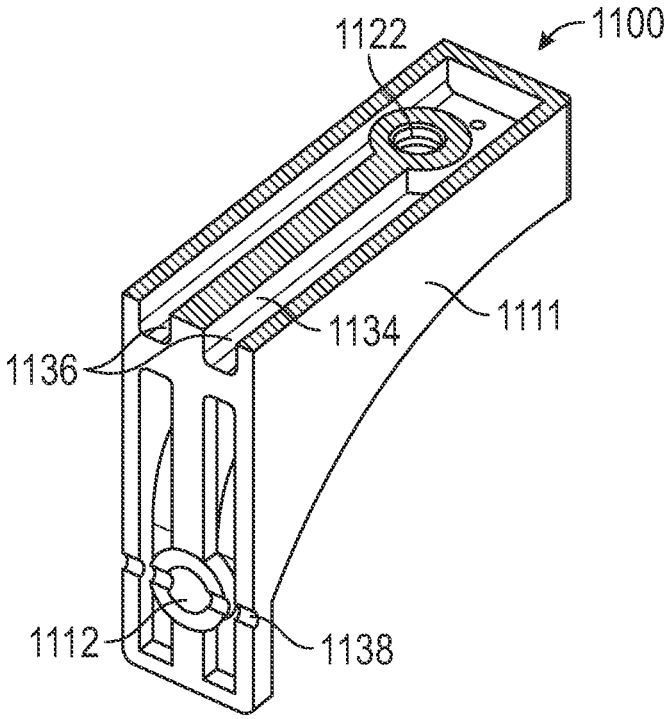
FIG. 19 is a cross sectional view of the sink mounting bracket of FIG. 15, taken along line 19-19 of FIG. 15.
Figure 20:
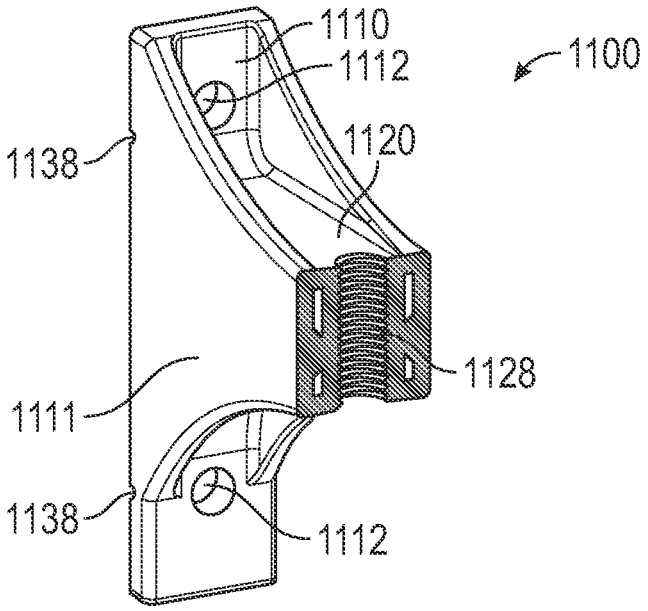
FIG. 20 is a cross sectional view of the sink mounting bracket of FIG. 12, taken along line 20-20 of FIG. 12.

As can be seen in FIGS. 14 and 15, the sink mounting bracket 1100 may be hollowed to reduce the amount of plastic used, and to reduce the weight of the bracket 1100. To provide reinforcement and strength in such a hollowed bracket 1100, an internal vertical support 1134 as well as an internal horizontal support 1136, which extend from the back of sink mounting bracket 1110 through the interior touching top and bottom interiors and the side interiors, may also be included.

As can be seen in FIGS. 11, 12, and 14-21, the rear or back of sink mounting bracket 1100 also includes notches or channels 1138 that are across a width of the bracket 1100. Additionally, as can be seen in FIGS. 11, 12, 18, 19 and 21, horizontal support flange 1120 includes a second hole 1142 that is positioned in front of mounting hole 1112. Features 1138 and 1142 are included, in some embodiments, for expansion and contraction of both metal and plastic as seasons change to relieve stress.

In general, sink mounting bracket 1100 may be of any suitable size. However, in one embodiment, sink mounting bracket 1100 is about 4 inches tall (bracket 1100 height is denoted by reference numeral 1144 in FIG. 13), about 3.25 inches long (bracket 1100 length is denoted by reference numeral 1146 in FIG. 13), has a thickness of bottom portion 1121 equal to about 0.25 inches (bottom portion 1121 thickness is denoted by reference numeral 1148 in FIG. 16), has a width 1150 (shown in FIG. 13) of about 1 inch, and a front of horizontal support flange 1120 has a height of about one inch (horizontal support flange 1120 front height is denoted by reference numeral 1152 in FIG. 13.

Figure 22:
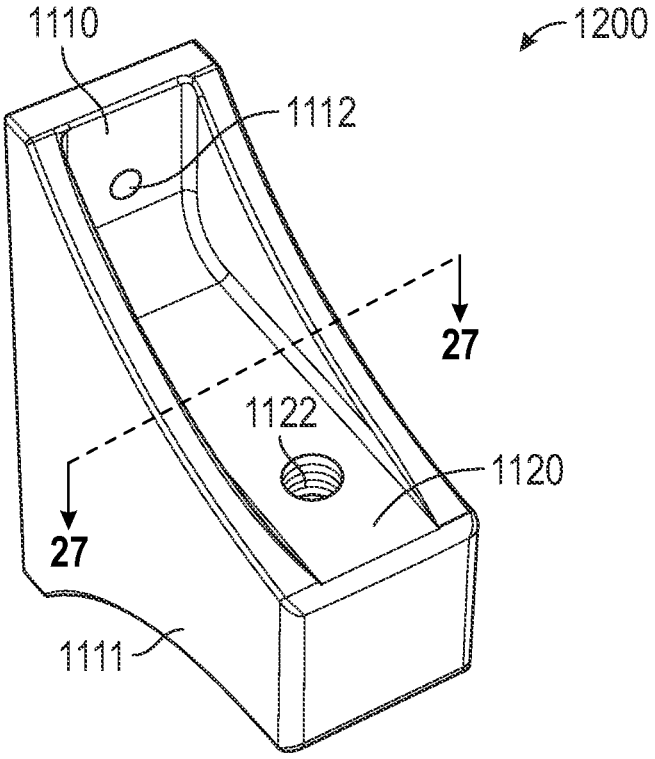
FIGS. 22 and 23 illustrate perspective views of a sink mounting bracket according to another embodiment of the present disclosure.
Figure 23:
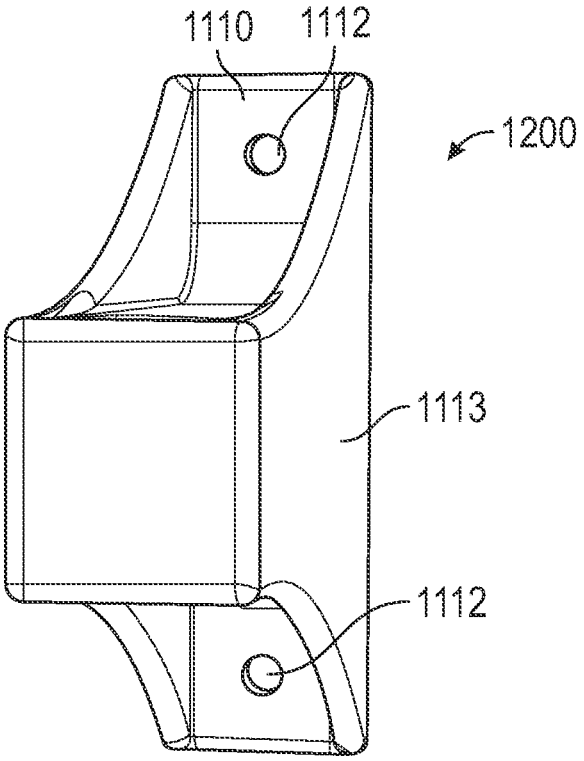
Figure 24:
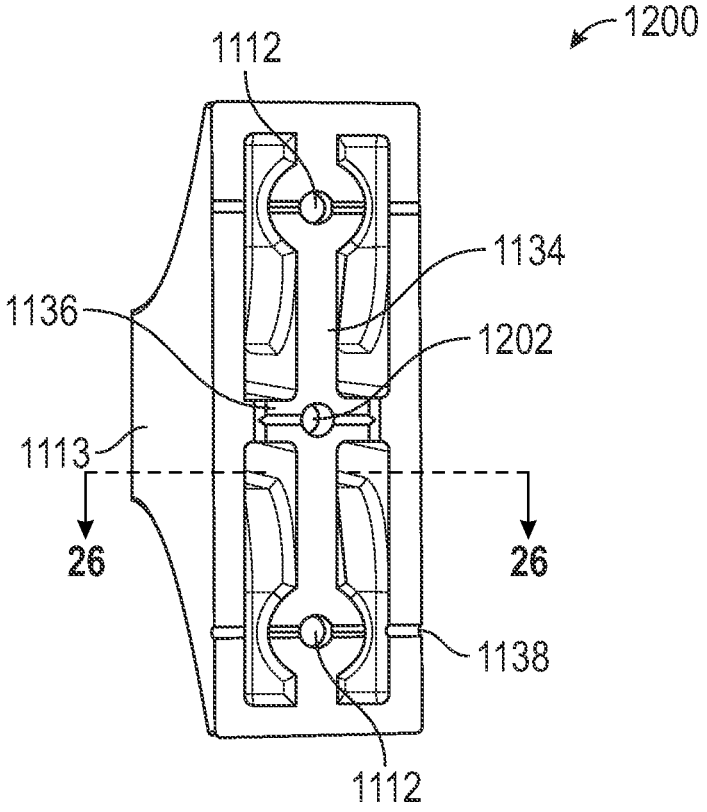
FIG. 24 illustrates a rear perspective view of the sink mounting bracket of FIGS. 22 and 23.
Figure 25:
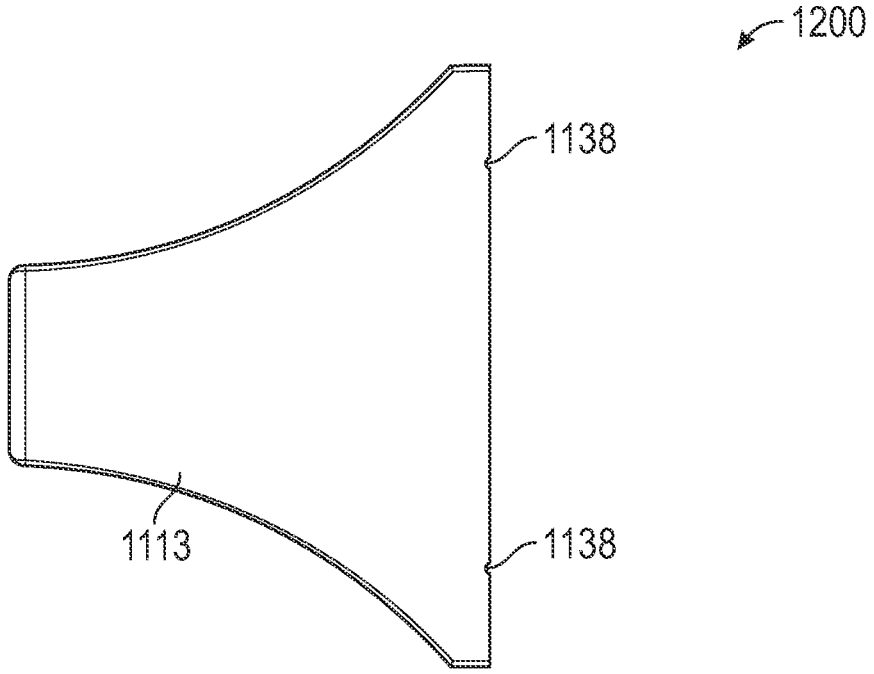
FIG. 25 illustrates a side view of the sink mounting bracket of FIGS. 22 and 23.
Figure 26:
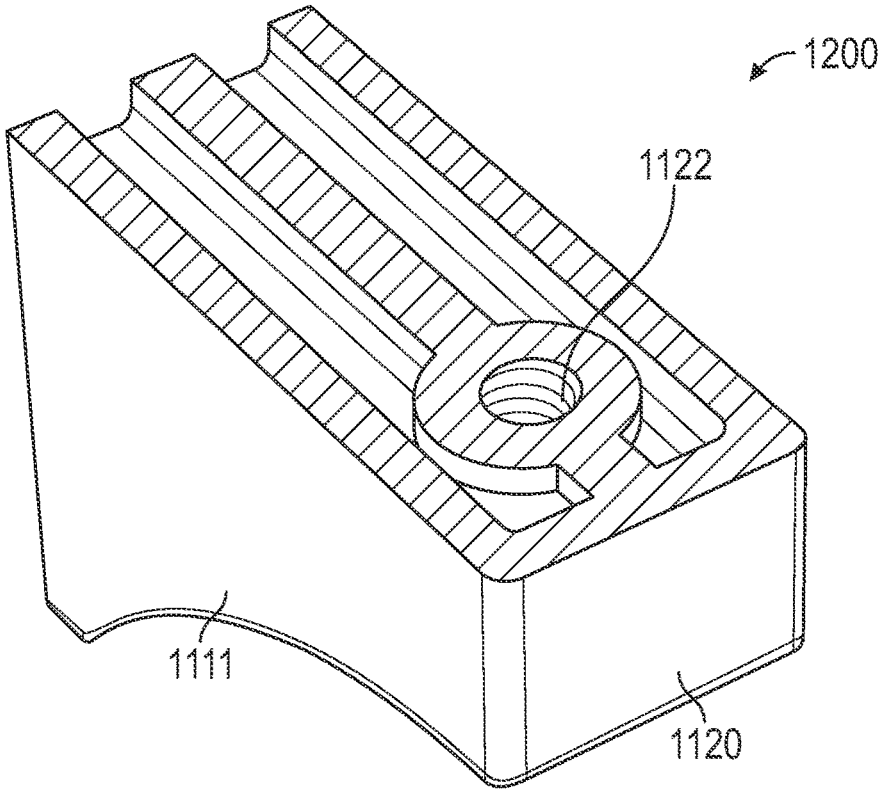
FIG. 26 is a cross sectional view of the sink mounting bracket of FIG. 24, taken along line 26-26 of FIG. 24.
Figure 27:
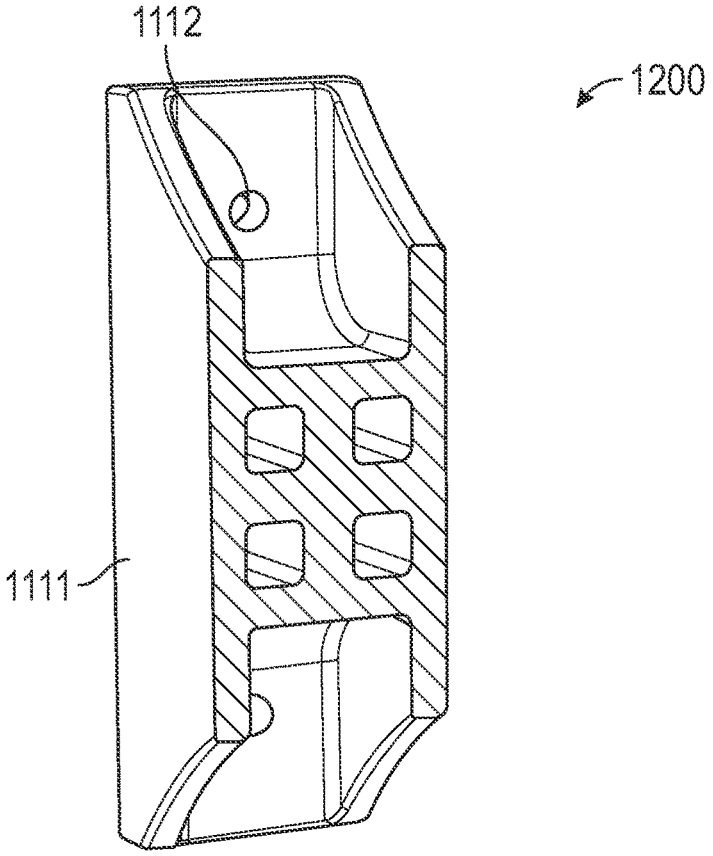
FIG. 27 is a cross sectional view of the sink mounting bracket of FIG. 22, taken along line 27-27 of FIG. 22.

FIGS. 22-27 show different views of a sink mounting bracket 1200 in accordance with another embodiment. Unlike sink mounting bracket 1100 of FIGS. 11-21, whose top and bottom portions are different, sink mounting bracket 1200 is symmetrical (e.g., has no different top and bottom portions). In other respects, sink mounting bracket 1200 is substantially similar to sink mounting bracket 1100, and therefore a description of the similar elements is not repeated in the interest of brevity. It should be noted that, in some embodiments, sink mounting bracket 1120 may includes a rear hole 1202 (shown in FIG. 24), which may have a diameter of about 5 millimeters (mm) in some embodiments. The 5 mm rear hole 1202 is suitable for receiving a shelf peg. Rear hole 1202 may be located in a middle of the rear of the sink mounting bracket 1120 as shown in FIG. 22. In some embodiments, rear hole 1202 may be located between mounting holes 1112 such that a distance between a center of rear hole 1202 and a center of each mounting hole is 32 mm.

In should be noted that, in some embodiments, the interiors of sink mounting brackets 1100 and 1200 may not have hollowed interiors (e.g., the brackets 1100 and 1200 may have solid interiors). Also, in some embodiments, horizontal support flange 1120 may include a socket (not shown in FIGS. 1-27) that is sized to receive locking mechanism (e.g., a threaded nut) such as 1135 of FIG. 21).

Figure 28:
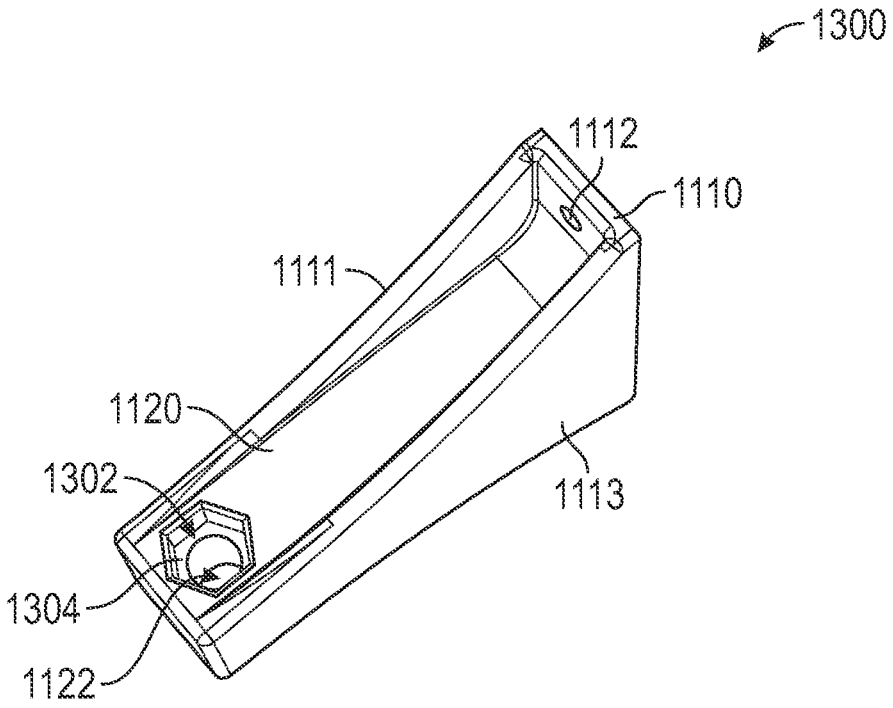
FIG. 28 illustrates a top perspective view of a sink mounting bracket according to another embodiment of the present disclosure.
Figure 29:
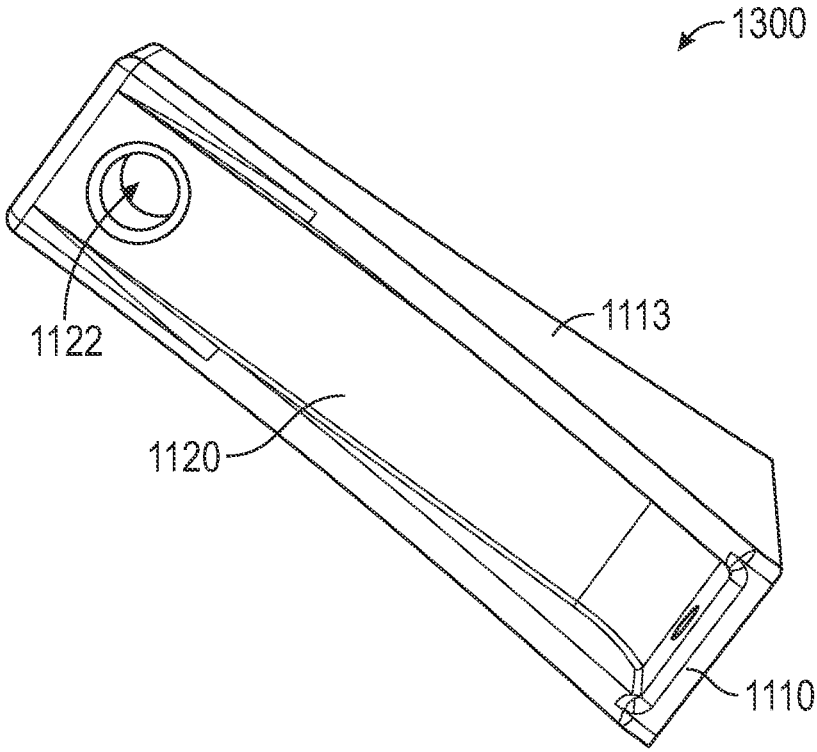
FIG. 29 illustrates a bottom perspective view of a sink mounting bracket according to another embodiment of the present disclosure.
Figure 30:
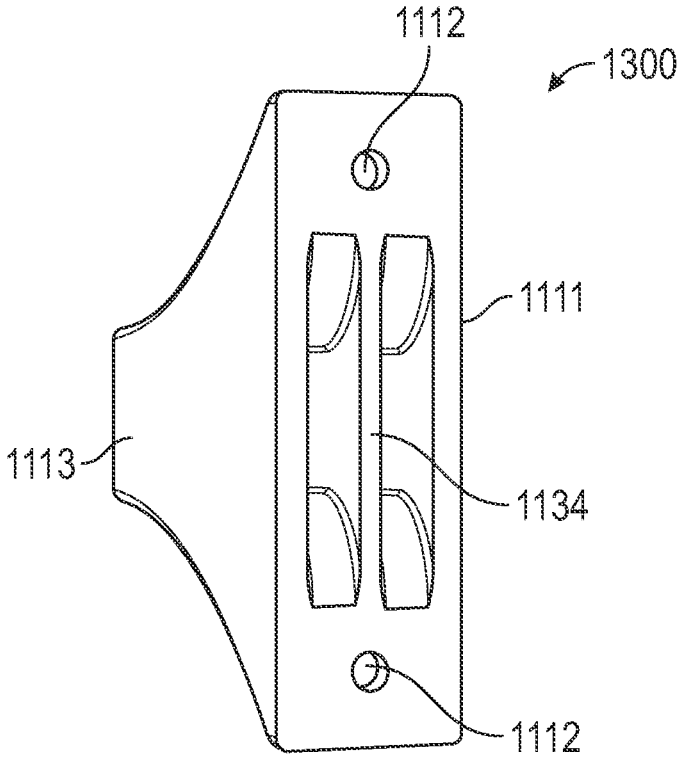
FIG. 30 illustrates a rear perspective view of the sink mounting bracket of FIGS. 28 and 29.
Figure 31:
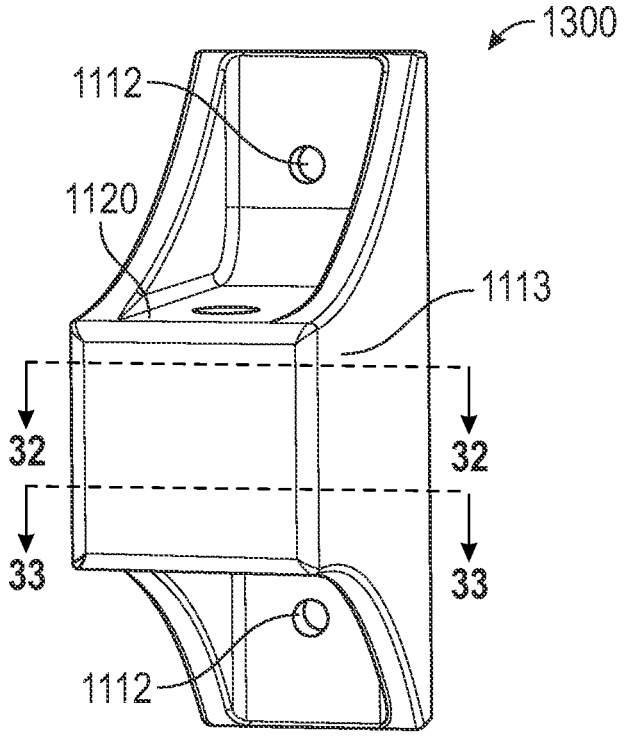
FIG. 31 illustrates a front perspective view of the sink mounting bracket of FIGS. 28 and 29.
Figure 32:
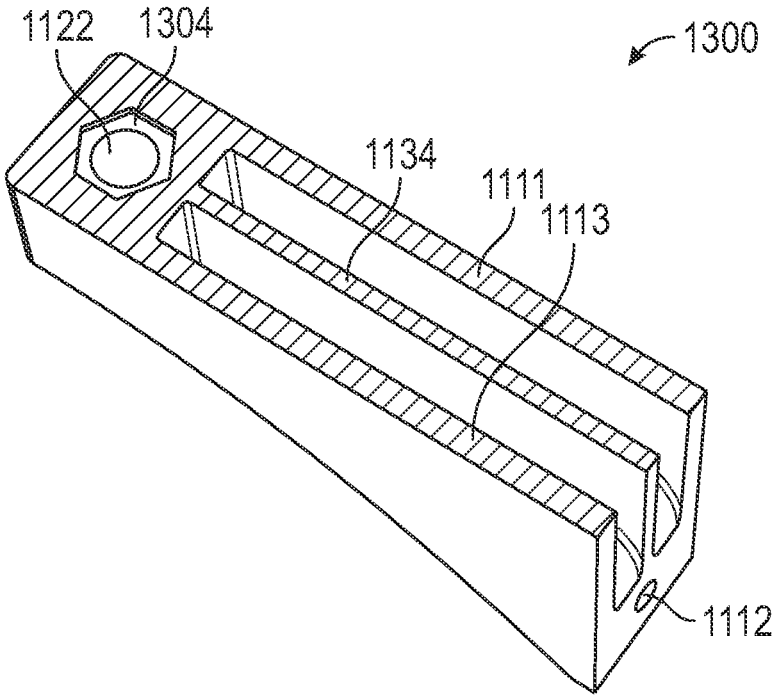
FIG. 32 is a cross sectional view of the sink mounting bracket of FIG. 31, taken along line 32-32 of FIG. 31.
Figure 33:
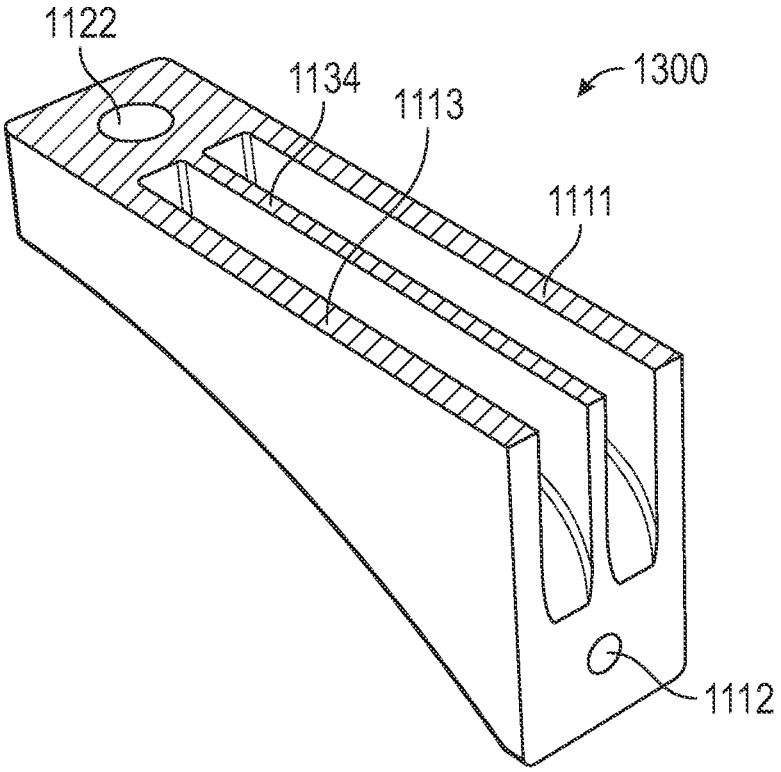
FIG. 33 is a cross sectional view of the sink mounting bracket of FIG. 31, taken along line 33-33 of FIG. 31.

FIGS. 28-33 show different views of a sink mounting bracket 1300 in accordance with yet another embodiment. In sink mounting bracket 1300, horizontal support flange 1120 includes a socket 1302 that is sized to receive locking mechanism (e.g., a threaded nut) such as 1135 of FIG. 21. Socket 1302 has a base 1304 (shown in FIGS. 28 and 32) that is a recessed portion of the top surface of the horizontal support flange 1120. As can be seen in FIGS. 28 and 32, base 1304 has an opening hole 1122. Like sink mounting bracket 1200 of FIGS. 21-27, sink mounting bracket 1300 is symmetrical (e.g., has no different top and bottom portions). However, unlike sink mounting bracket 1200, in some embodiments, sink mounting bracket 1300 has no internal horizontal support 1136, no rear hole 1202, no channel 1138, etc. In other respects, sink mounting bracket 1300 is substantially similar to sink mounting bracket 1200, and therefore a description of the similar elements is not repeated in the interest of brevity. It should be noted that, in alternate embodiments, sink mounting bracket 1300 may include one or more additional features such as 1136, 1202 and 1138.

Any suitable method (including molding) may be employed to form the plastic sink mounting brackets described above. Further, some of the metal sink mounting brackets are described above as being formed of a single metal piece. However, such metal sink mounting bracket may also be formed of multiple metal pieces. Further, at least some of the sink mounting brackets described above may be formed of a combination of metal and plastic. In general, any suitable material may be employed for the sink mounting brackets in different embodiments.

The embodiments described herein provide many benefits over other fixture support means. Apron sinks, for example, may have irregular and uneven bottom surfaces, and these surfaces make evenly supporting the weight of the fixture difficult and time consuming. Sink brackets that utilize horizontal supports that pass underneath the entirety of a fixture, for example, may inadequately support the uneven bottom surface of the fixture, such that the fixture may tilt out of alignment without additional fixture supports.

The embodiments described herein allow multiple brackets to be independently placed to support a fixture, and the adjustable support height of each bracket may be selectively increased or decreased to be adapted to the uneven bottom surface of the fixture. Thus, each bracket may be adjusted independently to level the fixture being supported. Further, the area in which a fixture is placed may have a variety of layouts and features which can impede fixture installation, and the disclosed embodiments provide the flexibility to be used with a variety of installation locations. For example, sink cabinetry may include different elements, such as a dishwasher, sink disposal or various piping which are taken into account when installing a fixture, and the brackets embodied herein allow an installer to individually place the brackets based on the fixture's installation location.

Although the embodiments have been described in relation to forming support for an apron sinks, this is exemplary only, and fixtures, such as sinks, bathtubs, counters, or shelving may also benefit from the sink mounting apparatus described herein. These embodiments may provide support for various fixtures without departing from the scope of the disclosure.

The illustrations of the embodiments described herein are intended to provide a general understanding of the method of the various embodiments. The illustrations are not intended to serve as a complete description of all of the elements and features of methods and systems described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

Although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

In addition, in the foregoing Detailed Description, various features may be grouped together or described in a single embodiment for the purpose of streamlining the disclosure. This disclosure is not to be interpreted as reflecting an intention that the claimed embodiments employ more features than are expressly recited in each claim. Rather, as the following claims reflect, inventive subject matter may be directed to less than all of the features of any of the disclosed embodiments.

The above-disclosed subject matter is to be considered illustrative, and not restrictive, and the appended claims are intended to cover all such modifications, enhancements, and other embodiments, which fall within the true spirit and scope of the present disclosure. Thus, to the maximum extent allowed by law, the scope of the present disclosure is to be determined by the broadest permissible interpretation of the following claims and their equivalents and shall not be restricted or limited by the foregoing detailed description.

What is claimed is:

1. A bracket comprising:

a mounting flange configured to couple to a mounting surface;

a support member coupled to the mounting flange with at least a portion of the support member being horizontal, the support member comprising a hole that extends from a top surface of the support member to a bottom surface of the support member, the hole being configured to receive an adjustable support;

a first vertical support flange coupled to the mounting flange, and rigidly coupled to a first side of the support member such that the first vertical support flange extends above and below the support member, and such that, after completion of manufacture of the bracket, the first vertical support flange remains immovably fixed to the support member; and a second vertical support flange coupled to the mounting flange, and rigidly coupled to a second side of the support member such that the second vertical support flange extends above and below the support member, and such that, after the completion of the manufacture of the bracket, the second vertical support flange remains immovably fixed to the support member; and wherein the support member comprises a socket that is configured to receive a fastener of the adjustable support, the socket having a base that is a recessed portion of the top surface of the support member.

2. The bracket of claim 1 and wherein the base of the socket comprises an opening into the hole in the support member.

3. The bracket of claim 2 and wherein the socket is configured to receive a nut of the adjustable support and the hole is configured to receive a bolt of the of the adjustable support.

4. The bracket of claim 1 and further comprising an internal vertical support between the first vertical support flange and the second vertical support flange.

5. The bracket of claim 1 and wherein the mounting flange, the support member, the first vertical support flange and the second vertical support flange comprise plastic.

6. A bracket comprising:

a mounting flange configured to couple to a mounting surface;

a support member coupled to the mounting flange with at least a portion of the support member being horizontal, the horizontal portion of the support member comprising a hole that extends from a top surface of the horizontal portion of support member to a bottom surface of the horizontal portion of the support member, the hole being configured to receive an adjustable support;

a first vertical support flange coupled to the mounting flange, and coupled to a first side of the support member such that the first vertical support flange extends above and below the support member;

a second vertical support flange coupled to the mounting flange, and coupled to a second side of the support member such that the second vertical support flange extends above and below the support member, wherein the horizontal portion of the support member is between the first and second vertical support flanges and comprises a single-layered piece that includes the hole, with an entirety of the bottom surface of the horizontal portion of the support member being uniplanar, and wherein the horizontal portion of the support member comprises a socket that is configured to receive a fastener of the adjustable support, the socket having a base that is a recessed portion of the top surface of the horizontal portion of the support member, and wherein the base of the socket comprises an opening into the hole in the horizontal portion of the support member.

7. The bracket of claim 6 and wherein the socket is configured to receive a nut of the adjustable support and the hole is configured to receive a bolt of the of the adjustable support.

8. The bracket of claim 6 and further comprising an internal vertical support between the first vertical support flange and the second vertical support flange.

9. The bracket of claim 6 and wherein the mounting flange, the support member, the first vertical support flange and the second vertical support flange comprise plastic.

10. A bracket comprising:

a mounting flange configured to couple to a mounting surface;

a support member coupled to the mounting flange with at least a portion of the support member being horizontal, the support member comprising a hole that extends from a top surface of the support member to a bottom surface of the support member, the hole being configured to receive an adjustable support;

a first vertical support flange coupled to the mounting flange, and coupled to a first side of the support member such that the first vertical support flange extends above and below the support member; and a second vertical support flange coupled to the mounting flange, and coupled to a second side of the support member such that the second vertical support flange extends above and below the support member, and wherein the support member comprises a socket that is configured to receive a fastener of the adjustable support, the socket having a base that is a recessed portion of the top surface of the support member.

11. The bracket of claim 10 and wherein the base of the socket comprises an opening into the hole in the support member.

12. The bracket of claim 11 and wherein the socket is configured to receive a nut of the adjustable support and the hole is configured to receive a bolt of the of the adjustable support.

13. The bracket of claim 10 and further comprising an internal vertical support between the first vertical support flange and the second vertical support flange.

14. The bracket of claim 10 and wherein the mounting flange, the support member, the first vertical support flange and the second vertical support flange comprise plastic.

* * * * *